US009803295B2

(12) United States Patent
Patel et al.

(10) Patent No.: US 9,803,295 B2
(45) Date of Patent: Oct. 31, 2017

(54) FIBERS FOR POLYETHYLENE NONWOVEN FABRIC

(75) Inventors: Rajen M. Patel, Lake Jackson, TX (US); Gert Claasen, Adliswil (CH); Wenbin Liang, Sugar Land, TX (US); Karin Katzer, Horgen (CH); Kenneth B. Stewart, Lake Jackson, TX (US); Thomas Allgeuer, Wollerau (CH); Jesus Nieto, Cambrils (ES)

(73) Assignee: Dow Global Technologies LLC, Midland, MI (US)

( * ) Notice: Subject to any disclaimer, the term of this patent is extended or adjusted under 35 U.S.C. 154(b) by 1729 days.

(21) Appl. No.: 11/578,646

(22) PCT Filed: Apr. 8, 2005

(86) PCT No.: PCT/US2005/012105

§ 371 (c)(1),
(2), (4) Date: Oct. 13, 2006

(87) PCT Pub. No.: WO2005/111291

PCT Pub. Date: Nov. 24, 2005

(65) Prior Publication Data

US 2008/0146110 A1 Jun. 19, 2008

Related U.S. Application Data

(60) Provisional application No. 60/567,400, filed on Apr. 30, 2004.

(51) Int. Cl.

| | |
|---|---|
| ***D01F 6/46*** | (2006.01) |
| ***D01F 8/06*** | (2006.01) |
| ***D04H 3/007*** | (2012.01) |
| ***D04H 3/147*** | (2012.01) |

(52) U.S. Cl.

CPC ..... *D01F 6/46* (2013.01); *D01F 8/06* (2013.01); *D04H 3/007* (2013.01); *D04H 3/147* (2013.01); *Y10T 428/298* (2015.01); *Y10T 442/608* (2015.04)

(58) Field of Classification Search

USPC ..... 428/364, 373

See application file for complete search history.

(56) References Cited

U.S. PATENT DOCUMENTS

| | | | | |
|---|---|---|---|---|
| 3,485,706 | A | 12/1969 | Evans | |
| 3,645,992 | A | 2/1972 | Elston | |
| 3,855,046 | A | 12/1974 | Hansen et al. | |
| 3,914,342 | A | 10/1975 | Mitchell | |
| 4,021,284 | A | 5/1977 | Kalwaites | |
| 4,024,612 | A | 5/1977 | Contractor et al. | |
| 4,076,698 | A | 2/1978 | Anderson et al. | |
| 4,578,414 | A | 3/1986 | Sawyer et al. | |
| 4,644,045 | A | 2/1987 | Fowells | |
| 4,701,432 | A | 10/1987 | Welborn, Jr. | |
| 4,830,907 | A | 5/1989 | Sawyer et al. | |
| 4,842,922 | A | 6/1989 | Krupp et al. | |
| 4,909,975 | A | 3/1990 | Sawyer et al. | |
| 4,935,397 | A | 6/1990 | Chang | |
| 4,937,301 | A | 6/1990 | Chang | |
| 4,939,016 | A | 7/1990 | Radwanski et al. | |
| 4,990,204 | A | 2/1991 | Krupp et al. | |
| 5,008,204 | A | 4/1991 | Stehling | |
| 5,055,438 | A | 10/1991 | Canich | |
| 5,068,141 | A | 11/1991 | Kubo et al. | |
| 5,112,686 | A | 5/1992 | Krupp et al. | |
| 5,218,071 | A | 6/1993 | Tsutsui et al. | |
| 5,246,783 | A | 9/1993 | Spenadel et al. | |
| 5,322,728 | A | 6/1994 | Davey et al. | |
| 5,336,552 | A | 8/1994 | Strack et al. | |
| 5,405,682 | A | 4/1995 | Shawyer et al. | |
| 5,425,987 | A | 6/1995 | Shawver et al. | |
| 5,545,464 | A | 8/1996 | Stokes | |
| 5,549,867 | A | 8/1996 | Gessner et al. | |
| 5,626,571 | A | 5/1997 | Young et al. | |
| 5,677,383 | A | 10/1997 | Chum et al. | |
| 5,804,286 | A | 9/1998 | Quantrille et al. | |
| 5,844,045 | A | 12/1998 | Kolthammer et al. | |
| 5,869,575 | A | 2/1999 | Kolthammer et al. | |
| 5,964,742 | A | 10/1999 | McCormack et al. | |
| 6,015,605 | A | 1/2000 | Tsujiyama et al. | |
| 6,015,617 | A * | 1/2000 | Maugans et al. | 428/364 |
| 6,270,891 | B1 | 8/2001 | Maugans et al. | |
| 6,316,549 | B1 | 11/2001 | Chum et al. | |
| 6,448,341 | B1 | 9/2002 | Kolthammer et al. | |
| 6,448,355 | B1 | 9/2002 | Knight et al. | |
| 6,516,472 | B2 | 2/2003 | Gessner et al. | |
| 2003/0003830 | A1 * | 1/2003 | Ouederni et al. | 442/327 |

FOREIGN PATENT DOCUMENTS

| | | |
|---|---|---|
| EP | 0 260 999 A1 | 3/1988 |
| EP | 0 129 368 B1 | 7/1989 |

(Continued)

OTHER PUBLICATIONS

John Dealy, *Rheometers for Molten Plastics*, 97, (1982) : Van Nostrand Reinhold Co.

(Continued)

*Primary Examiner* — Lynda Salvatore

(57) ABSTRACT

The present invention relates to nonwoven webs or fabrics. In particular, the present invention relates to nonwoven webs having superior abrasion resistance and excellent softness characteristics. The nonwoven materials comprise monocomponent fibers having a surface comprising a polyethylene, said nonwoven material having a fuzz/abrasion of less than 0.7 mg/cm$^3$. The present invention is also related to fibers having a diameter in a range of from 0.1 to 50 denier, said fibers comprising a polymer blend, wherein the polymer blend comprises: from 40 weight percent to 80 weight percent (by weight of the polymer blend) of a first polymer which is a homogeneous ethylene/α-olefin interpolymer having: a melt index of from about 1 to about 1000 grams/10 minutes, and a density of from 0.870 to 0.950 grams/centimeter$^3$, and from 74 to 20 percent by weight of a second polymer which is an ethylene homopolymer or an ethylene/α-olefin interpolymer having a melt index of from about 1 to about 1000 grams/10 minutes, and preferably a density which is at least 0.01 grams/centimeter$^3$ greater than the density of the first polymer.

29 Claims, No Drawings

(56) References Cited

FOREIGN PATENT DOCUMENTS

| | | | |
|---|---|---|---|
| EP | 0 340 982 | B1 | 9/1994 |
| EP | 0 795 053 | B1 | 9/1997 |
| WO | WO-90/07526 | A1 | 7/1990 |
| WO | WO-93/13143 | A1 | 7/1993 |
| WO | WO-95/32091 | A1 | 11/1995 |
| WO | WO-01/32771 | A1 | 5/2001 |
| WO | WO-02/31245 | A2 | 4/2002 |
| WO | WO-02/48440 | A2 | 6/2002 |
| WO | WO-03/008680 | A1 | 1/2003 |

OTHER PUBLICATIONS

Randall "Ethylene-Based Polymers," Journal of Macromolecular Science: Reviews in Macromolecular Chemisty and Physics, 275-287, C29 (2 & 3) (1989).

M. Shida, R.N. Shroff, and L.V. Cancio, "Correlation of Low Density Polyethylene Rheological Measurements with Optical and Processing Properties," Polymer Engineering and Science, 769-774, vol. 17, No. 11, (1977).

A.V. Ramamurthy, "Wall Slip in Viscous Fluids and Influence of Materials of Construction," Journal of Rheology, 337-357, vol. 30, No. 2, (1986), : John Wiley & Sons, Inc.

I.M. Ward and T. Williams, "The Construction of a Polyethylene Calibration Curve for Gel Permeation Chromotography Using Polystyrene Fractions," Journal of Polymer Science: Polymer Letters, 621-624, vol. 6 (1968).

L. Wild, T.R. Ryle, D.C. Knobeloch, and I.R. Peat, "Determination of Branching Distributions in Polyethylene and Ethylene Copolymers," 441-455, vol. 20, (1982) : John Wiley & Sons, Inc.

* cited by examiner

FIBERS FOR POLYETHYLENE NONWOVEN FABRIC

This application claims the benefit of Provisional Application 60/567,400, filed on Apr. 30, 2004, which is hereby incorporated by reference in its entirety.

The present invention relates to nonwoven webs or fabrics. In particular, the present invention relates to nonwoven webs having superior abrasion resistance and excellent softness characteristics. The present invention is also related to fibers, particularly those suitable for use in nonwoven material, particularly spunbonded fibers comprising particular polymer blends.

Nonwoven webs or fabrics are desirable for use in a variety of products such as bandaging materials, garments, disposable diapers, and other personal hygiene products, including pre-moistened wipes. Nonwoven webs having high levels of strength, softness, and abrasion resistance are desirable for disposable absorbent garments, such as diapers, incontinence briefs, training pants, feminine hygiene garments, and the like. For example, in a disposable diaper, it is highly desirable to have soft, strong, nonwoven components, such as topsheets or backsheets (also known as outer covers). Topsheets form the inner, body-contacting portion of a diaper which makes softness highly beneficial. Backsheets benefit from the appearance of being cloth-like, and softness adds to the cloth-like perception consumers prefer. Abrasion resistance relates to a nonwoven web's durability, and is characterized by a lack of significant loss of fibers in use.

Abrasion resistance can be characterized by a nonwoven's tendency to "fuzz," which may also be described as "linting" or "pilling". Fuzzing occurs as fibers, or small bundles of fibers, are rubbed off, pulled, off, or otherwise released from the surface of the nonwoven web. Fuzzing can result in fibers remaining on the skin or clothing of the wearer or others, as well as a loss of integrity in the nonwoven, both highly undesirable conditions for users.

Fuzzing can be controlled in much the same way that strength is imparted, that is, by bonding or entangling adjacent fibers in the nonwoven web to one another. To the extent that fibers of the nonwoven web are bonded to, or entangled with, one another, strength can be increased, and fuzzing levels can be controlled.

Softness can be improved by mechanically post treating a nonwoven. For example, by incrementally stretching a nonwoven web by the method disclosed in U.S. Pat. No. 5,626,571, issued May 6, 1997 in the names of Young et al., it can be made soft and extensible, while retaining sufficient strength for use in disposable absorbent articles. Dobrin et al. '976, which is hereby incorporated herein by reference, teaches making a nonwoven web soft and extensible by employing opposed pressure applicators having three-dimensional surfaces which at least to a degree are complementary to one another. Young et al., which is hereby incorporated herein by reference, teaches making a nonwoven web which is soft and strong by permanently stretching an inelastic base nonwoven in the cross-machine direction. However, neither Young et al., nor Dobrin et al., teach the non-fuzzing tendency of their respective nonwoven webs. For example, the method of Dobrin et al. may result in a nonwoven web having a relatively high fuzzing tendency. That is, the soft, extensible nonwoven web of Dobrin et al. has relatively low abrasion resistance, and tends to fuzz as it is handled or used in product applications.

One method of bonding, or "consolidating", a nonwoven web is to bond adjacent fibers in a regular pattern of spaced, thermal spot bonds. One suitable method of thermal bonding is described in U.S. Pat. No. 3,855,046, issued Dec. 17, 1974 to Hansen et al., which is hereby incorporated herein by reference. Hansen et al. teach a thermal bond pattern having a 10-25 percent bond area (termed "consolidation area" herein) to render the surfaces of the nonwoven web abrasion resistant. However, even greater abrasion resistance together with increased softness can further benefit the use of nonwoven webs in many applications, including disposable absorbent articles, such as diapers, training pants, feminine hygiene articles, and the like.

By increasing the size of the bond sites; or by decreasing the distance between bond sites, more fibers are bonded, and abrasion resistance can be increased, (fuzzing can be reduced). However, the corresponding increase in bond area of the nonwoven also increases the bending rigidity (that is, stiffness), which is inversely related to a perception of softness (that is as bending rigidity increases, softness decreases). In other words, abrasion resistance is directly proportional to bending rigidity when achieved by known methods. Because abrasion resistance correlates to fuzzing, and bending resistance correlates to perceived softness, known methods of nonwoven production require a tradeoff between the fuzzing and softness properties of a nonwoven.

Various approaches have been tried to improve the abrasion resistance of nonwoven materials without compromising softness. For example, U.S. Pat. Nos. 5,405,682 and 5,425,987, both issued to Shawyer et al. teach a soft, yet durable, cloth-like nonwoven fabric—made with multicomponent polymeric strands. However, the multicomponent fibers disclosed comprise a relatively expensive elastomeric thermoplastic material (that is KRATONS) in one side or the sheath of multicomponent polymeric strands. U.S. Pat. No. 5,336,552 issued to Strack et al. discloses a similar approach in which an ethylene alkyl acrylate copolymer is used as an abrasion resistance additive in multicomponent polyolefin fibers. U.S. Pat. No. 5,545,464, issued to Stokes describes a pattern bonded nonwoven fabric of conjugate fibers in which a lower melting point polymer is enveloped by a higher melting point polymer.

Bond patterns have also been utilized to improve strength and abrasion resistance in nonwovens while maintaining or even improving softness. Various bond patterns have been developed to achieve improved abrasion resistance without too negatively affecting softness. U.S. Pat. No. 5,964,742 issued to McCormack et al. discloses a thermal bonding pattern comprising elements having a predetermined aspect ratio. The specified bond shapes reportedly provide sufficient numbers of immobilized fibers to strengthen the fabric, yet not so much as to increase stiffness unacceptably. U.S. Pat. No. 6,015,605 issued to TsuJiyama et al. discloses very specific thermally press bonded portions in order to deliver strength, hand feeling, and abrasion resistance. However, with all bond pattern solutions it is believed that the essential tradeoff between bond area and softness remains.

Another approach for improving the abrasion resistance of nonwoven materials without compromising softness is to optimize the polymer content of the fibers used to make the nonwoven materials. A variety of fibers and fabrics have been made from thermoplastics, such as polypropylene, highly branched low density polyethylene (LDPE) made typically in a high pressure polymerization process, linear heterogeneously branched polyethylene (for example, linear low density polyethylene made using Ziegler catalysis), blends of polypropylene and linear heterogeneously branched polyethylene, blends of linear heterogeneously branched polyethylene, and ethylene/vinyl alcohol copolymers.

Of the various polymers known to be extrudable into fiber, highly branched LDPE has not been successfully melt spun into fine denier fiber. Linear heterogeneously branched polyethylene has been made into monofilament, as described in U.S. Pat. No. 4,076,698 (Anderson et al.), the disclosure of which is incorporated herein by reference. Linear heterogeneously branched polyethylene has also been successfully made into tine denier fiber, as disclosed in U.S. Pat. No. 4,644,045 (Fowells), U.S. Pat. No. 4,830,907 (Sawyer et al.), U.S. Pat. No. 4,909,975 (Sawyer et al.) and in U.S. Pat. No. 4,578,414 (Sawyer et al.), the disclosures of which are incorporated herein by reference. Blends of such heterogeneously branched polyethylene have also been successfully made into fine denier fiber and fabrics, as disclosed in U.S. Pat. No. 4,842,922 (Krupp et al.), U.S. Pat. No. 4,990,204 (Krupp et al.) and U.S. Pat. No. 5,112,686 (Krupp et al.), the disclosures of which are all incorporated herein by reference. U.S. Pat. No. 5,068,141 (Kubo et al.) also discloses making nonwoven fabrics from continuous heat bonded filaments of certain heterogeneously branched LLDPE having specified heats of fusion. While the use of blends of heterogeneously branched polymers produces improved fabric, the polymers are more difficult to spin without fiber breaks.

U.S. Pat. No. 5,549,867 (Gessner et al.), describes the addition of a low molecular weight polyolefin to a polyolefin with a molecular weight (Mz) of from 400,000 to 580,000 to improve spinning. The Examples set forth in Gessner et al. are directed to blends of 10 to 30 weight percent of a lower molecular weight metallocene polypropylene with from 70 to 90 weight percent of a higher molecular weight polypropylene produced using a Ziegler-Natta catalyst.

WO 95/32091 (Stahl et al.) discloses a reduction in bonding temperatures by utilizing blends of fibers produced from polypropylene resins having different melting points and produced by different fiber manufacturing processes, for example, meltblown and spunbond fibers. Stahl et al. claims a fiber comprising a blend of an isotactic propylene copolymer with a higher melting thermoplastic polymer. However, while Stahl et al. provides some teaching as to the manipulation of bond temperature by using blends of different fibers, Stahl et al. does not provide guidance as to means for improving fabric strength of fabric made from fibers having the same melting point.

U.S. Pat. No. 5,677,383, in the names of Lai, Knight, Chum, and Markovich, incorporated herein by reference, discloses blends of substantially linear ethylene polymers with heterogeneously branched ethylene polymers, and the use of such blends in a variety of end use applications, including fibers. The disclosed compositions preferably comprise a substantially linear ethylene polymer having a density of at least 0.89 grams/centimeter$^3$. However, Lai et al. disclosed fabrication temperatures only above 165° C. In contrast, to preserve fiber integrity, fabrics are frequently bonded at lower temperatures, such that all of the crystalline material is not melted before or during fusion.

European Patent Publication (EP) 340,982 discloses bicomponent fibers comprising a first component core and a second component sheath, which second component further comprises a blend of an amorphous polymer with an at least partially crystalline polymer. The disclosed range of the amorphous polymer to the crystalline polymer is from 15:85 to 90:10. Preferably, the second component will comprise crystalline and amorphous polymers of the same general polymeric type as the first component, with polyester being preferred. For instance, the examples disclose the use of an amorphous and a crystalline polyester as the second component. EP 340,982, at Tables I and II, indicates that as the melt index of the amorphous polymer decreases, the web strength likewise detrimentally decreases. Incumbent polymer compositions include linear low density polyethylene and high density polyethylene having a melt index generally in the range of 0.7 to 200 grams/10 minutes.

U.S. Pat. Nos. 6,015,617 and 6,270,891 teach the inclusion of a low melting point homogeneous polymer to a higher melting point polymer having an optimum melt index can usefully provide a calendered fabric having an improved bond performance, while maintaining adequate fiber spinning performance.

U.S. Pat. No. 5,804,286 teaches that the bonding of LLDPE filaments into a spunbond web with acceptable abrasion resistance is difficult since the temperature at which acceptable tie down is observed is nearly the same as the temperature at which the filaments melt and stick to the calendar. This reference concludes that this explains why spunbonded LLDPE nonwovens have not found wide commercial acceptance.

While such polymers have found good success in the marketplace in fiber applications, the fibers made from such polymers would benefit from an improvement in bond strength, which would lead to abrasion-resistant fabrics, and accordingly to increased value to the nonwoven fabric and article manufacturers, as well as to the ultimate consumer. However, any benefit in bond strength must not be at the cost of a detrimental reduction in spinnability or a detrimental increase in the sticking of the fibers or fabric to equipment during processing.

Accordingly, there is a continuing unaddressed need for a nonwoven having a sufficiently high percentage of bond area for abrasion resistance, while maintaining sufficiently low bending rigidity, especially in a machine direction, for a desirable perception of softness.

Additionally, there is a continuing unaddressed need for a low fuzzing, soft nonwoven suitable for use as a component in a disposable absorbent article.

Additionally, there is a continuing unaddressed need for a soft, extensible nonwoven web having relatively high abrasion resistance.

Further, there is a continuing unaddressed need for a method of processing a nonwoven such that abrasion resistance is achieved with little or no decrease in softness.

There is also a need for fibers, particularly spunbond fibers which have a broader bonding window, increased bonding strength and abrasion resistance, improved softness and good spinnability.

In one aspect, the present invention provides a nonwoven material having a Fuzz/Abrasion of less than 0.7 mg/cm$^2$, and a flexural rigidity of less than 0.15 mN·cm. The nonwoven material should have a basis weight greater than 15 grams/m$^2$, a tensile strength of more than 10 N/5 cm MD and 7 N/5 cm CD (at a basis weight of 20 GSM), and a consolidation area of less than 25%.

In another aspect, the present invention is a fiber from 0.1 to 50 denier which comprises a polymer blend, wherein the polymer blend comprises:

a. from 40 weight percent to 80 weight percent (by weight of the polymer blend) of a first polymer which is a homogeneous ethylene/α-olefin interpolymer having:

i. a melt index of from 1 to 1000 grams/10 minutes, and ii. a density of from 0.870 to 0.950 grams/centimeter$^3$, and b. from 60 to 20 percent by weight of a second polymer which is an ethylene homopolymer or an ethylene/α-olefin interpolymer having:

i. a melt index of from 1 to 1000 grams/10 minutes, and preferably ii. a density which is at least 0.01 grams/centimeter$^3$ greater than the density of the first polymer.

In another aspect, the present invention is a fiber having a diameter in a range of from 0.1 to 50 denier which comprises a polymer blend, wherein the polymer blend comprises:

a. from 10 weight percent to 80 weight percent (by weight of the polymer blend) of a first polymer which is a homogeneous ethylene/α-olefin interpolymer having:

i. a melt index of from 1 to 1000 grams/10 minutes, and ii. a density of from 0.920 to 0.950 grams/centimeter$^3$, and b. from 90 to 20 percent by weight of a second polymer which is an ethylene homopolymer or an ethylene/α-olefin interpolymer having:

i. a melt index of from 1 to 1000 grams/10 minutes, and preferably ii. a density which is at least 0.01 grams/centimeter$^3$ greater than the density of the first polymer.

Preferably, the fiber of the invention will be prepared from a polymer composition comprising:

a. at least one substantially linear ethylene α-olefin interpolymer having:

i. a melt flow ratio, $I_{10}/I_2$, ≥5.63, ii. a molecular weight distribution, Mw/Mn, defined by the equation: $M_w/M_n \leq (I_{10}/I_2)-4.63$, iii. a critical shear rate at onset of surface melt fracture of at least 50 percent greater than the critical shear rate at the onset of surface melt fracture of a linear ethylene polymer having about the same $I_2$ and $M_w/M_n$, and iv. a density less than about 0.935 grams/centimeter$^3$, and b. at least one ethylene polymer having a density greater than about 0.935 grams/centimeter$^3$.

As used herein, the term "absorbent article" refers to devices which absorb and contain body exudates, and, more specifically, refers to devices which are placed against or in proximity to the body of the wearer to absorb and contain the various exudates discharged from the body.

The term "disposable" is used herein to describe absorbent articles which are not intended to be laundered or otherwise restored or reused as an absorbent article (that is, they are intended to be discarded after a single use and, preferably, to be recycled, composted or otherwise disposed of in an environmentally compatible manner). A "unitary" absorbent article refers to absorbent articles which are formed of separate parts united together to form a coordinated entity so that they do not require separate manipulative parts like a separate holder and liner.

As used herein, the term "nonwoven web", refers to a web that has a structure of individual fibers or threads which are interlaid, but not in any regular, repeating manner. Nonwoven webs have been, in the past, formed by a variety of processes, such as, for example, air laying processes, meltblowing processes, spunbonding processes and carding processes, including bonded carded web processes.

As used herein, the term "microfibers", refers to small diameter fibers having an average diameter not greater than about 100 microns. Fibers, and in particular, spunbond fibers utilized in the present invention can be microfibers, or more specifically, they can be fibers having an average diameter of 15-30 microns, and having a denier from 1.5-3.0.

As used herein, the term "meltblown fibers", refers to fibers formed by extruding a molten thermoplastic material through a plurality of fine, usually circular, die capillaries as molten threads or filaments into a high velocity gas (for example, air) stream which attenuates the filaments of molten thermoplastic material to reduce their diameter, which may be to a microfiber diameter. Thereafter, the meltblown fibers are carried by the high velocity gas stream and are deposited on a collecting surface to form a web of randomly dispersed meltblown fibers.

As used herein, the term "spunbonded fibers", refers to small diameter fibers which are formed by extruding a molten thermoplastic material as filaments from a plurality of fine, usually circular, capillaries of a spinneret with the diameter of the extruded filaments then being rapidly reduced by drawing.

As used herein, the terms "consolidation" and "consolidated" refer to the bringing together of at least a portion of the fibers of a nonwoven web into closer proximity to form a site, or sites, which function to increase the resistance of the nonwoven to external forces, for example, abrasion and tensile forces, as compared to the unconsolidated web. "Consolidated" can refer to an entire nonwoven web that has been processed such that at least a portion of the fibers are brought into closer proximity, such as by thermal point bonding. Such a web can be considered a "consolidated web". In another sense, a specific, discrete region of fibers that is brought into close proximity, such as an individual thermal bond site, can be described as "consolidated".

Consolidation can be achieved by methods that apply heat and/or pressure to the fibrous web, such as thermal spot (that is, point) bonding. Thermal point bonding can be accomplished by passing the fibrous web through a pressure nip formed by two rolls, one of which is heated and contains a plurality of raised points on its surface, as is described in the aforementioned U.S. Pat. No. 3,855,046 issued to Hansen et al. Consolidation methods can also include ultrasonic bonding, through-air bonding, and hydroentanglement. Hydroentanglement typically involves treatment of the fibrous web with high pressure water jets to consolidate the web via mechanical fiber entanglement (friction) in the region desired to be consolidated, with the sites being formed in the area of fiber entanglement. The fibers can be hydroentangled as taught in U.S. Pat. Nos. 4,021,284 issued to Kalwaites on May 3, 1977 and 4,024,612 issued to Contrator et al. on May 24, 1977, both of which are hereby incorporated herein by reference. In the currently preferred embodiment, the polymeric fibers of the nonwoven are consolidated by point bonds, sometimes referred to as "partial consolidation" because of the plurality of discrete, spaced-apart bond sites.

As used herein, the term "polymer" generally includes, but is not limited to, homopolymers, copolymers, such as, for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "extensible" refers to any material which, upon application of a biasing force, is elongatable, to at least about 50 more preferably at least about 70 percent without experiencing catastrophic failure.

All percentages specified herein are weight percentages unless otherwise specified.

As used herein a "nonwoven" or "nonwoven fabric" or "nonwoven material" means an assembly of fibers held together in a random web such as by mechanical interlocking or by fusing at least a portion of the fibers. Nonwoven fabrics can be made by various methods, including spunlaced (or hydrodynamically entangled) fabrics as disclosed in U.S. Pat. No. 3,485,706 (Evans) and U.S. Pat. No. 4,939,016 (Radwanski et al.), the disclosures of which are incorporated herein by reference; by carding and thermally bonding staple fibers; by spunbonding continuous fibers in one continuous operation; or by melt blowing fibers into fabric and subsequently calendering or thermally bonding the resultant web. These various nonwoven fabric manufacturing techniques are well known to those skilled in the art. The fibers of the present invention are particularly well suited to make a spunbonded nonwoven material.

The nonwoven material of the present invention will have a basis weight (weight per unit area) from 10 grams per square meter (gsm) to 100 gsm. The basis weight can also be from 15 gsm to 60 gsm, and in one embodiment it was 20 gsm. Suitable base nonwoven webs can have an average filament denier of 0.10 to 10. Very low deniers can be achieved by the use of splittable fiber technology, for example. In general, reducing the filament denier tends to produce softer fibrous webs, and low denier microfibers from about 0.10 to 2.0 denier can be utilized for even greater softness.

The degree of consolidation can be expressed as a percentage of the total surface area of the web that is consolidated. Consolidation can be substantially complete, as when an adhesive is uniformly coated on the surface of the nonwoven, or when bicomponent fibers are sufficiently heated so as to bond virtually every fiber to every adjacent fiber. Generally, however, consolidation is preferably partial, as in point bonding, such as thermal point bonding.

The discrete, spaced-apart bond sites formed by point bonding, such as thermal point bonding, only bond the fibers of the nonwoven in the area of localized energy input. Fibers or portions of fibers remote from the localized energy input remain substantially unbonded to adjacent fibers.

Similarly, with respect to ultrasonic or hydroentanglement methods, discrete, spaced apart bond sites can be formed to make a partially consolidated nonwoven web. The consolidation area, when consolidated by these methods, refers to the area per unit area occupied by the localized sites formed by bonding the fibers into point bonds (alternately referred to as "bond sites"), typically as a percentage of total unit area. A method of determining consolidation area is detailed below.

Consolidation area can be determined from scanning electron microscope (SEM) images with the aid of image analysis software. One or preferably more SEM images can be taken from different positions on a nonwoven web sample at 20× magnification. These images can be saved digitally and imported into Image-Pro PlusO software for analysis. The bonded areas can then be traced and the percent area for these areas be calculated based on the total area of the SEM image. The average of images can be taken as the consolidation area for the sample.

A web of the present invention preferably exhibits a percent consolidation area of less than about 25 percent, more preferably less than about 22 percent prior to mechanical post-treatment, if any.

The web of the present invention is characterized by high abrasion resistance and high softness, which properties are quantified by the web's tendency to fuzz and bending or flexural rigidity, respectively. Fuzz levels (or "fuzz/abrasion") and flexural rigidity were determined according to the methods set out in the Test Methods section of WO02/31245, herein incorporated by reference in its entirety.

Fuzz levels, tensile strength and flexural rigidity are partly dependent on the basis weight of the nonwoven, as well as whether the fiber is made from a monocomponent (or monofilament) or a bicomponent (typically sheath/core) filament. For purposes of this invention a "monocomponent" fiber means a fiber in which the cross-section is relatively uniform. It should be understood that the cross section may comprise blends of more than one polymer but that it will not include "bicomponent" structures such as sheath-core, side-by-side islands in the sea, etc. In general heavier fabrics (that is fabrics at higher basis weight) will have higher fuzz levels, everything else being equal. Similarly heavier fabrics will tend to have higher values for tenacity and flexural rigidity and lower values for softness as determined according to the BBA softness panel test as described in S. Woekner, "Softness and Touch—Important aspects of Nonwovens", edana International Nonwovens Symposium, Rome Italy June (2003).

The nonwoven materials of the present invention preferably exhibit a fuzz/abrasion of less than about 0.7 mg/cm$^2$, more preferably less than about 0.6 mg/cm$^2$, most preferably less than about 0.5 mg/cm$^2$. As an example of the dependence upon basis weight, when the basis weight of a nonwoven made from monofilament is approximately in the range of 20-27 gsm, the abrasion (mg/cm$^2$) should be less than or equal to 0.0214(BW)+0.2714, where BW is the basis weight in g/m$^2$. Preferably it will be less than 0.0214(BW)+0.1714, more preferably less than or equal to 0.0214(BW)+0.0714. In these equations, it should be understood that the formulas already take into account unit conversions such that when the basis weight is inserted into the formula in grams/m$^2$, the abrasion result. (for example) is given in mg/cm$^2$ without further conversion. For fabric made using primarily a bicomponent fiber, the abrasion should be less than or equal to 0.0071(BW)+0.4071, preferably less than or equal to 0.0143(BW)+0.1643, and most preferably less than or equal to 0.0143(BW)+0.1143.

It should be understood that the relationships cited as applicable in the 20-27 gsm basis weight may also hold outside of the 20-27 gsm basis weight specified.

The flexural rigidity was determined in both the machine direction (MD) and the cross direction (CD), and in the MD for a fabric basis weight of 20-27 gsm is preferably less than about 0.4 mN·cm, more preferably less than about 0.2 mN·cm, still more preferably less than about 0.15 mN·cm and most preferably less than about 0.11 mN·cm. In the CD, the fabric will preferably have a flexural rigidity of less than about 0.2 mN·cm, more preferably less than about 0.15 mN·cm, still more preferably less than about 0.10 mN·cm and most preferably less than about 0.08 mN·cm. When the basis weight of a nonwoven made from monofilament fiber is approximately in the range of 20-27 gsm, the flexural rigidity in the MD (mN·cm) should be less than or equal to 0.0286(BW)−0.3714, preferably less than or equal to 0.0214(BW)−0.2786, most preferably less than or equal to 0.0057(BW)−0.0043. For nonwovens made with bicomponent filament, the relationships would be less than or equal to 0.0714(BW)−1.0286, more preferably less than or equal to 0.0714(BW)−1.0786.

Tensile strength for the nonwoven materials were measured using a constant rate of extension tensile tester, such as those produced by Instron and the like. For each reported result, 5 samples were tested, and the reported results are an average. Results are reported as the load in force per unit width (for example N/5 cm) at maximum and peak elongation is also reported as elongation percentage at maximum force. Testing was performed in a conditioned room controlled to 23±1° C. (73±2° F.) and 50±2 percent relative humidity. Testing was performed in both the Machine direction (MD) and the cross direction (CD). The nonwoven materials of the present invention have a tensile strength of greater than about 10 N/5 cm in the MD, more preferably greater than 11, more preferably greater than 13 and still more preferably greater than 15 N/5 cm. In the cross direction, the nonwoven materials will have a tensile strength of greater than about 7 N/5 cm, more preferably greater than 8, more preferably greater than 10 and still more preferably greater than 11 N/5 cm. Tensile strength is also a function of basis weight and so it is preferred that the tensile strength (N/5 cm) be greater than or equal to 0.4286(BW)+1.4286, more preferably greater than or equal to 0.4286(BW)+2.4286. In the cross direction, it is preferred that the tensile strength be greater than or equal to 0.4286(BW)−1.5714, more preferably greater than or equal to 0.4286(BW)−0.5714. As before. these relationships are particularly relevant in the range of from 20 to 27 grams per square meter basis weight.

Nonwoven materials can also be described in terms of their elongation at peak force in the machine direction. The fabrics of the present invention preferably have an elongation at peak force in the machine direction of greater than 70 percent, more preferably greater than 80 percent, still more preferably greater than about 90 percent and most preferably greater than about 100 percent. This factor is also a function of the basis weight, and at least for the range of 20-27 gsm, it is preferred that the nonwoven have an elongation (percent) greater than 1.4286(BW)+41.429, more preferably greater than 1.4286(BW)+51.429, and most preferably greater than about 1.4286(BW)+61.429.

The nonwoven materials can also be characterized according to their softness. One method of determining a value for softness is a panel test as described in S. Woekner, "Softness and Touch—Important aspects of Non-wovens", edana International Nonwovens Symposium, Rome Italy June (2003). It is preferred that the fabric of the present invention have a softness greater than or equal to about 1 softness personal unit ("SPU"), more preferably greater than about 2 and still more preferably greater than about 3 SPUs. The softness values also are inversely correlated with the basis weight, and for fabrics made with monofilament (particularly in the range of 20-27 gsm), it is preferred that the fabric have a softness (SPUs) greater than or equal to 5.6286−0.1714(BW), more preferably 5.3571−0.1429(BW), and most preferably 5.8571−0.1429(BW). Fabrics made with bicomponent fibers tend to be less soft, and so for these materials (particularly in the range of 20-27 gsm) it is preferred that the nonwoven materials have a softness greater than or equal to 2.9286−0.0714(BW), more preferably greater than or equal to 3.4286−0.0714(BW).

It has been found that the nonwoven materials of the present invention can advantageously made using a fiber having a diameter in a range of from 0.1 to 50 denier which comprises a polymer blend, wherein the polymer blend comprises:

a. from 40 weight percent to 80 weight percent (by weight of the polymer blend) of a first polymer which is a homogeneous ethylene/α-olefin interpolymer having:

i. a melt index of from 1 to 1000 grams/10 minutes, and ii. a density of from 0.870 to 0.950 grams/centimeter$^3$, and b. a second polymer which is an ethylene homopolymer or an ethylene/α-olefin interpolymer having:

i. a melt index of from 1 to 1000 grams/10 minutes, and preferably ii. a density which is at least 0.01 grams/centimeter$^3$ greater than the density of the first polymer.

It has been found that the nonwoven materials of the present invention can alternatively advantageously made using a fiber having a diameter in a range of from 0.1 to 50 denier which comprises a polymer blend, wherein the polymer blend comprises:

a. from 10 weight percent to 80 weight percent (by weight of the polymer blend) of a first polymer which is a homogeneous ethylene/α-olefin interpolymer having:

i. a melt index of from 1 to 1000 grams/11 minutes, and ii. a density of from 0.921 to 0.950 grams/centimeter$^3$, and b. a second polymer which is an ethylene homopolymer or an ethylene/α-olefin interpolymer having:

i. a melt index of from 1 to 1000 grams/10 minutes, and preferably ii. a density which is at least 0.01 grams/centimeter$^3$ greater than the density of the first polymer.

The homogeneously branched substantially linear ethylene polymers used in the polymer compositions disclosed herein can be interpolymers of ethylene with at least one $C_3$-$C_{20}$ α-olefin. The term "interpolymer" and "ethylene polymer" used herein indicates that the polymer can be a copolymer, a terpolymer, etc. Monomers usefully copolymerized with ethylene to make the homogeneously branched linear or substantially linear ethylene polymers include the $C_3$-$C_{20}$ α-olefins especially 1-pentene, 1-hexene, 4-methyl-1-pentene, and 1-octene. Especially preferred comonomers include 1-pentene, 1-hexene and 1-octene. Copolymers of ethylene and a $C_3$-$C_{20}$ α-olefin are especially preferred.

The term "substantially linear" means that the polymer backbone is substituted with from 0.01 long chain branches/1000 carbons to 3 long chain branches/1000 carbons, more preferably from 0.01 long chain branches/1000 carbons to 1 long chain branches/1000 carbons, and especially from 0.05 long chain branches/1000 carbons to 1 long chain branches/1000 carbons.

Long chain branching is defined herein as a branch having a chain length greater than that of any short chain branches which are a result of comonomer incorporation. The long chain branch can be as long as about the same length as the length of the polymer back-bone.

Long chain branching can be determined by using $^{13}C$ nuclear magnetic resonance (NMR) spectroscopy and is quantified using the method of Randall (*Rev. Macromol. Chem. Phys.*, C29 (2&3), p. 275-287), the disclosure of which is incorporated herein by reference.

In the case of substantially linear ethylene polymers, such polymers can be characterized as having:

a) a melt flow ratio, $I_{10}/I_2$, ≥5.63, b) a molecular weight distribution, $M_w/M_n$, defined by the equation:

$$M_w/M_n \leq (I_{10}/I_2)-4.63, \text{ and}$$

c) a critical shear stress at onset of gross melt fracture greater than $4\times10^6$ dynes/cm$^2$ and/or a critical shear rate at onset of surface melt fracture at least 50 percent greater than the critical shear rate at the onset of surface melt fracture of either a homogeneously or heterogeneously branched linear ethylene polymer having about the same $I_2$ and $M_w/M_n$.

In contrast to substantially linear ethylene polymers, linear ethylene polymers lack long chain branching, that is, they have less than 0.01 long chain branches/1000 carbons. The term "linear ethylene polymers" thus does not refer to high pressure branched polyethylene, ethylene/vinyl acetate copolymers, or ethylene/vinyl alcohol copolymers which are known to those skilled in the art to have numerous long chain branches.

Linear ethylene polymers include, for example, the traditional heterogeneously branched linear low density polyethylene polymers or linear high density polyethylene polymers made using Ziegler polymerization processes (for example, U.S. Pat. No. 4,076,698 (Anderson et al.)) the disclosure of which is incorporated herein by reference), or homogeneous linear polymers (for example, U.S. Pat. No. 3,645,992 (Elston) the disclosure of which is incorporated herein by reference).

Both the homogeneous linear and the substantially linear ethylene polymers used to form the fibers have homogeneous branching distributions. The term "homogeneously branching distribution" means that the comonomer is randomly distributed within a given molecule and that substantially all of the copolymer molecules have the same ethylene/comonomer ratio.

The homogeneity of the branching distribution can be measured variously, including measuring the SCBDI (Short Chain Branch Distribution Index) or CDBI (Composition Distribution Branch Index). SCBDI or CDBI is defined as the weight percent of the polymer molecules having a comonomer content within 50 percent of the median total molar comonomer content. The CDBI of a polymer is readily calculated from data obtained from techniques known in the art, such as, for example, temperature rising elusion fractionation (abbreviated herein as "TREF") as described, for example, in Wild et al, *Journal of Polymer Science, Poly. Phys. Ed.*, Vol. 20, p. 441 (1982), U.S. Pat. No. 5,008,204 (Stehling), the disclosure of which is incorporated herein by reference. The technique for calculating CDBI is described in U.S. Pat. No. 5,322,728 (Davey et al.) and in U.S. Pat. No. 5,246,783 (Spenadel et al.), both disclosures of which are incorporated herein by reference. The SCBDI or CDBI for homogeneously branched linear and substantially linear ethylene polymers is typically greater than 30 percent, and is preferably greater than 50 percent, more preferably greater than 60 percent, even more preferably greater than 70 percent, and most preferably greater than 90 percent.

The homogeneous linear and substantially linear ethylene polymers used to make the fibers of the present invention will typically have a single peak, as measured using differential scanning calorimetry (DSC) or TREF.

Substantially linear ethylene polymers exhibit a highly unexpected flow property where the $I_{10}/I_2$ value of the polymer is essentially independent of polydispersity index (that is, $M_w/M_n$) of the polymer. This is contrasted with conventional homogeneous linear ethylene polymers and heterogeneously branched linear polyethylene resins for which one must increase the polydispersity index in order to increase the $I_{10}/I_2$ value. Substantially linear ethylene polymers also exhibit good processability and low pressure drop through a spinneret pack, even when using high shear filtration.

Homogeneous linear ethylene polymers useful to make the fibers and fabrics of the invention are a known class of polymers which have a linear polymer backbone, no long chain branching and a narrow molecular weight distribution. Such polymers are interpolymers of ethylene and at least one α-olefin comonomer of from 3 to 20 carbon atoms, and are preferably copolymers of ethylene with a $C_3$-$C_{20}$ α-olefin, and are most preferably copolymers of ethylene with propylene, 1-butene, 1-hexene, 4-methyl-1-pentene or 1-octene. This class of polymers is disclosed, for example, by Elston in U.S. Pat. No. 3,645,992 and subsequent processes to produce such polymers using metallocene catalysts have been developed, as shown, for example, in EP 0 129 368, EP 0 260 999, U.S. Pat. Nos. 4,701,432; 4,937,301; 4,935,397; 5,055,438; and WO 90/07526, and others. The polymers can be made by conventional polymerization processes (for example, gas phase, slurry, solution, and high pressure).

The first polymer will be a homogeneous linear or substantially linear ethylene polymer, having a density, as measured in accordance with ASTM D-792 of at least 0.870 grams/centimeter$^3$, preferably at least 0.880 grams/centimeter$^3$, and more preferably at least 0.90 grams/centimeter$^3$; and most preferably at least 0.915 grams/centimeter$^3$ and which is typically no more than 0.945 grams/centimeter$^3$, preferably no more than 0.940 grams/centimeter$^3$, more preferably no more that 0.930 grams/centimeter$^3$, and most preferably no more than 0.925 grams/centimeter$^3$. The second polymer will have a density which is at least 0.01 grams/centimeter$^3$, preferably at least 0.015, still more preferably 0.02 grams/centimeter$^3$, more preferably at least 0.25 grams/centimeter$^3$, and most preferably at least 0.03 grams/centimeter$^3$ greater than that of the first polymer. The second polymer will typically have a density of at least 0.880 grams/centimeter$^3$, preferably at least 0.900 grams/centimeter$^3$, more preferably at least 0.935 grams/centimeter$^3$, even more preferably at least 0.940 grams/centimeter$^3$ and most preferably at least 0.945 grams/centimeter$^3$.

The molecular weight of the first and second polymers used to make the fibers and fabrics of the present invention is conveniently indicated using a melt index measurement according to ASTM D-1238, Condition 190° C./2.16 kg (formally known as "Condition (E)" and also known as $I_2$). Melt index is inversely proportional to the molecular weight of the polymer. Thus, the higher the molecular weight, the lower the melt index, although the relationship is not linear. The melt index for the first polymer is generally at least 1 grams/10 minutes, preferably at least 5 grams/10 minutes, more preferably at least 10 grams/10 minutes; and even more preferably at least about 15 grams/10 minutes, generally no more than 1000 grams/10 minutes. The melt index for the second polymer is generally at least 1 grams/10 minutes, preferably at least 5 grams/10 minutes, and more preferably at least 10 grams/10 minutes; and even more preferably at least about 15 grams/10 minutes and generally less than about 1000 grams/10 minutes. For spunbond fibers, the melt index of the second polymer is preferably at least 15 grams/10 minutes, more preferably at least 20 grams/10 minutes; preferably no more than 100 grams/10 minutes.

Another measurement useful in characterizing the molecular weight of ethylene polymers is conveniently indicated using a melt index measurement according to ASTM D-1238, Condition 190° C./10 kg (formerly known as "Condition (N)" and also known as $I_{10}$). The ratio of these two melt index terms is the melt flow ratio and is designated as $I_{10}/I_2$. For the substantially linear ethylene polymers used polymer compositions useful in making the fibers of the invention, the $I_{10}/I_2$ ratio indicates the degree of long chain branching, that is, the higher the $I_{10}/I_2$ ratio, the more long chain branching in the polymer. The substantially linear ethylene polymers can have varying $I_{10}/I_2$ ratios, while maintaining a low molecular weight distribution (that is, $M_w/M_n$ from 1.5 to 2.5). Generally, the $I_{10}/I_2$ ratio of the substantially linear ethylene polymers is at least 5.63, preferably at least 6, more preferably at least 7. Generally, the upper limit of $I_{10}/I_2$ ratio for the homogeneously branched substantially linear ethylene polymers is 15 or less, but can be less than 9, or even less than 6.63.

Additives such as antioxidants (for example, hindered phenolics (for example, Irganox® 1010 made by Ciba-Geigy Corp.), phosphites (for example, Irgafos®) 168 made by Ciba-Geigy Corp.), cling additives (for example, polyisobutylene (PIB)), polymeric processing aids (such as Dynamar™ 5911 from Dyneon Corporation, and Silquest™ PA-1 from General Electric), antiblock additives, pigments, can also be included in the first polymer, the second polymer, or the overall polymer composition useful to make the fibers and fabrics of the invention, to the extent that they do not interfere with the enhanced fiber and fabric properties discovered by Applicants.

The whole interpolymer product samples and the individual interpolymer components are analyzed by gel permeation chromatography (GPC) on a Waters 150° C. high temperature chromatographic unit equipped with mixed porosity columns operating at a system temperature of 140° C. The solvent is 1,2,4-trichlorobenzene, from which 0.3 percent by weight solutions of the samples are prepared for injection. The flow rate is 1.0 milliliters/minute and the injection size is 100 microliters.

The molecular weight determination is deduced by using narrow molecular weight distribution polystyrene standards (from Polymer Laboratories) in conjunction with their elution volumes. The equivalent polyethylene molecular weights are determined by using appropriate Mark-Houwink coefficients for polyethylene and polystyrene (as described by Williams and Ward in *Journal of Polymer Science, Polymer Letters*, Vol. 6, (621) 1968) to derive the following equation:

$$M_{polyethylene}=a*(M_{polystyrene})^b$$

In this equation, a=0.4316 and b=1.0. Weight average molecular weight, $M_w$, and number average molecular weight, $M_n$, is calculated in the usual manner according to the following formula:

$$M_j=(\Sigma w_i(M_i^j))^{1/j};$$

where $w_i$ is the weight fraction of the molecules with molecular weight $M_i$ eluting from the GPC column in fraction i and j=1 when calculating $M_w$ and j=−1 when calculating $M_n$.

The $M_w/M_n$ of the substantially linear homogeneously branched ethylene polymers is defined by the equation:

$$M_w/M_n \leq (I_{10}/I_2)-4.63$$

Preferably, the $M_w/M_n$ for both the homogeneous linear and substantially linear ethylene polymers is from 1.5 to 2.5, and especially from 1.8 to 2.2.

An apparent shear stress versus apparent shear rate plot is used to identify the melt fracture phenomena. According to Ramamurthy in *Journal of Rheology,* 30(2), 337-357, 1986, above a certain critical flow rate, the observed extrudate irregularities may be broadly classified into two main types: surface melt fracture and gross melt fracture.

Surface melt fracture occurs under apparently steady flow conditions and ranges in detail from loss of specular gloss to the more severe form of "sharkskin". In this disclosure, the onset of surface melt fracture is characterized at the beginning of losing extrudate gloss at which the surface roughness of extrudate can only be detected by 40× magnification. The critical shear rate at onset of surface melt fracture for a substantially linear ethylene polymer is at least 50 percent greater than the critical shear rate at the onset of surface melt fracture of a homogeneous linear ethylene polymer having the same $I_2$ and $M_w/M_n$.

Gross melt fracture occurs at unsteady flow conditions and ranges in detail from regular (alternating rough and smooth, helical, etc.) to random distortions. For commercial acceptability, (for example, in blown film products), surface defects should be minimal, if not absent. The critical shear rate at onset of surface melt fracture (OSMF) and onset of gross melt fracture (OGMF) will be used herein based on the changes of surface roughness and configurations of the extrudates extruded by a GER.

The gas extrusion rheometer is described by M. Shida, R. N. Shroff and L. V. Cancio in *Polymer Engineering Science*, Vol. 17, no. 11, p. 770 (1977), and in "Rheometers for Molten Plastics" by John Dealy, published by Van Nostrand Reinhold Co. (1982) on page 97, both publications of which are incorporated by reference herein in their entirety. All GER experiments are performed at a temperature of 190° C., at nitrogen pressures between 5250 to 500 psig using a 0.0296 inch diameter, 20:1 L/D die. An apparent shear stress vs. apparent shear rate plot is used to identify the melt fracture phenomena. According to Ramamurthy in *Journal of Rheology,* 30(2), 337-357, 1986, above a certain critical flow rate, the observed extrudate irregularities may be broadly classified into two main types: surface melt fracture and gross melt fracture.

For the polymers described herein, the PI is the apparent viscosity (in Kpoise) of a material measured by GER at a temperature of 190° C., at nitrogen pressure of 2500 psig using a 0.0296 inch diameter, 20:1 L/D die, or corresponding apparent shear stress of $2.15\times10^6$ dyne/cm$^2$.

The processing index is measured at a temperature of 190° C., at nitrogen pressure of 2500 psig using 0.0296 inch diameter, 20:1 L/D die having an entrance angle of 180°.

The polymers may be produced via a continuous (as opposed to a batch) controlled polymerization process using at least one reactor, but can also be produced using multiple reactors (for example, using a multiple reactor configuration as described in U.S. Pat. No. 3,914,342 (Mitchell), incorporated herein by reference), with the second ethylene polymer polymerized in at least one other reactor. The multiple reactors can be operated in series or in parallel, with at least one constrained geometry catalyst or other single site catalyst employed in at least one of the reactors at a polymerization temperature and pressure sufficient to produce the ethylene polymers having the desired properties. According to a preferred embodiment of the present process, the polymers are produced in a continuous process, as opposed to a batch process. Preferably, the polymerization temperature is from 20° C. to 250° C., using constrained geometry catalyst technology. If a narrow molecular weight distribution polymer ($M_w/M_n$ of from 1.5 to 2.5) having a higher $I_{10}/I_2$ ratio (for example, $I_{10}/I_2$ of 7 or more, preferably at least 8, especially at least 9) is desired, the ethylene concentration in the reactor is preferably not more than 8 percent by weight of the reactor contents, especially not more than 4 percent by weight of the reactor contents. Preferably, the polymerization is performed in a solution polymerization process. Generally, manipulation of $I_{10}/I_2$ while holding $M_w/M_n$ relatively low for producing the substantially linear polymers described herein is a function of reactor temperature and/or ethylene concentration. Reduced ethylene concentration and higher temperature generally produces higher $I_{10}/I_2$.

The polymerization conditions for manufacturing the homogeneous linear or substantially linear ethylene polymers used to make the fibers of the present invention are generally those useful in the solution polymerization process, although the application of the present invention is not limited thereto. Slurry and gas phase polymerization processes are also believed to be useful, provided the proper catalysts and polymerization conditions are employed.

One technique for polymerizing the homogeneous linear ethylene polymers useful herein is disclosed in U.S. Pat. No. 3,645,992 (Elston), the disclosure of which is incorporated herein by reference.

In general, the continuous polymerization according to the present invention may be accomplished at conditions well known in the prior art for Ziegler-Natta or Kaminsky-Sinn type polymerization reactions, that is, temperatures from 0 to 250° C. and pressures from atmospheric to 1000 atmospheres (100 MPa).

The compositions disclosed herein can be formed by any convenient method, including dry blending the individual components and subsequently melt mixing or by pre-melt mixing in a separate extruder (for example, a Banbury mixer, a Haake mixer, a Brabender internal mixer, or a twin screw extruder), or in a dual reactor.

Another technique for making the compositions in-situ is disclosed in U.S. Pat. No. 5,844,045, the disclosure of which is incorporated herein in its entirety by reference. This reference describes, inter alia, interpolymerizations of ethylene and $C_3$-$C_{20}$ alpha-olefins using a homogeneous catalyst in at least one reactor and a heterogeneous catalyst in at least one other reactor. The reactors can be operated sequentially or in parallel.

The compositions can also be made by fractionating a heterogeneous ethylene/α-olefin polymer into specific polymer fractions with each fraction having a narrow composition (that is, branching) distribution, selecting the fraction having the specified properties, and blending the selected fraction in the appropriate amounts with another ethylene polymer. This method is obviously not as economical as the in-situ interpolymerizations of U.S. Ser. No. 08/010,958, but can be used to obtain the compositions of the invention.

It should be understood that the fibers of the present invention can be continuous or noncontinuous, such as staple fibers. Staple fibers of the present invention can advantageously be used in carded webs. Furthermore, it should be understood that in addition to the nonwoven materials described above, the fibers can be used in any other fiber application known in the art, such as binder fibers. Binder fibers of the present invention can be in the form a sheath-core bicomponent fiber and the sheath of the fiber comprises the polymer blend. It may also be desired to blend an amount of a polyolefin grafted with an unsaturated organic compound containing at least one site of ethylenic unsaturation and at least one carbonyl group. Most preferably the unsaturated organic compound is maleic anhydride. Binder fibers of the present invention can advantageously be used in an airlaid web, preferably where the binder fibers comprise 5-35 percent by weight of the airlaid web.

EXAMPLES

A series of fibers were used to make a series of nonwoven fabrics. The resins were as follows: Resin A is a Ziegler-Natta ethylene-1-octene copolymer having a melt index ($I_2$) of 30 gram/10 minutes and a density of 0.955 g/cc. Resin B is a Ziegler-Natta ethylene-1-octene copolymer having a melt index ($I_2$) of 27 gram/10 minutes and a density of 0.941 g/cc. Resin C is a homogeneous substantially linear ethylene/1-octene copolymer having a melt index ($I_2$) of 30 gram/10 minutes and a density of 0.913 g/cc. Resin D is an ethylene/1-octene copolymer, comprising about 40 percent (by weight) of a substantially linear polyethylene component having a melt index of about 30 g/10 minutes and a density of about 0.915 g/cc and about 60 percent of a heterogenous Ziegler Natta polyethylene component; the final polymer composition has a melt index of about 30 g/10 minutes and a density of about 0.9364 g/cc. Resin E is an ethylene/1-octene copolymer, comprising about 40 percent (by weight) of a substantially linear polyethylene component having a melt index of about 15 g/10 minutes and a density of about 0.915 g/cc and about 60 percent of a heterogenous Ziegler Natta polyethylene component; the final polymer composition has a melt index of about 22 g/10 minutes and a density of about 0.9356 g/cc. Resin F is an ethylene/1-octene copolymer, comprising about 40 percent (by weight) of a substantially linear polyethylene component having a melt index of about 15 g/10 minutes and a density of about 0.915 g/cc and about 60 percent of a heterogenous Ziegler Natta polyethylene component; the final polymer composition has a melt index of about 30 g/10 minutes and a density of about 0.9367 g/cc. Resin G is an ethylene/1-octene copolymer, comprising about 55 percent (by weight) of a substantially linear polyethylene component having a melt index of about 15 g/10 minutes and a density of about 0.927 g/cc and about 45 percent of a heterogenous Ziegler Natta polyethylene component; the final polymer composition has a melt index of about 20 g/10 minutes and a density of about 0.9377 g/cc. Resin H is homopolymer polyproylene having a melt flow rate of 25 g/10 minutes in accordance with ASTM D-1238 condition 230° C./2.16 kg.

Resins D, E, F, and G can be made according to U.S. Pat. Nos. 5,844,045, 5,869,575, 6,448,341, the disclosures of which are incorporated herein by reference. Melt index is measured in accordance with ASTM D-1238, condition 190° C./2.16 kg and density is measured in accordance with ASTM D-792.

Nonwoven fabric was made using the resins indicated in Table 1 and evaluated for spinning and bonding performance. The trials were carried out on a spunbond line which used a Reicofil III technology with a beam width of 1.2 meters. The line was run at an output of 107 kg/hour/meter (0.4 g/min/hole) for all polyethylene resins and 118 kg/hour/meter (0.45 g/min/hole) with the polypropylene resin. Resins were spun to make about 2.5 denier fibers, corresponding to the fiber velocity of about 1500 m/min at 0.4 g/min/hole output rate. A mono spin pack was used in this trial, Each spinneret hole had a diameter of 0.6 mm (600 micron) and a L/D ratio of 4. Polyethylene fibers were spun at a melt temperature of 210° C. to 230° C., and polypropylene fibers were spun at a melt temperature of about 230° C.

The embossed roll of the chosen calendar had an oval pattern with a bonding surface of 16.19 percent, with 49.9 bond points per $cm^2$, a land area width of 0.83 mm×0.5 mm and a depth of 0.84 mm.

For the polypropylene resin the embossed calendar and smooth roll were set at the same oil temperature. For polyethylene resins the smooth roll was set 2° C. lower than the embossed roll (this was to reduce tendency of roll wrap). All calendar temperatures that are mentioned in this report were the oil temperature of the embossed roll. The surface temperatures on the calendars were not measured. The nip pressure was maintained at 70 N/mm for all the resins.

| Example # | Resin | Basis Weight | Bonding Temp ° C. | Mono or bicomponent filament | Abrasion ($mg/cm^2$) | Flexural Rigidity (mN·cm) MD; CD | Elongation to Peak Force percent | Tenacity (N/5 cm); MD; CD | Softness (SPU) |
|---|---|---|---|---|---|---|---|---|---|
| Comp. 1 | 100 percent H | 20 | 145 | mono | 0.183 | 0.7; 0.3 | 63.8; 78.25 | 49.73; 37.18 | 0.7 |

-continued

| Example # | Resin | Basis Weight | Bonding Temp ° C. | Mono or bicomponent filament | Abrasion (mg/cm$^{2)}$ | Flexural Rigidity (mN·cm) MD; CD | Elongation to Peak Force percent | Tenacity (N/5 cm); MD; CD | Softness (SPU) |
|---|---|---|---|---|---|---|---|---|---|
| Comp 2 | 100 percent A | 20 | 130 | Mono | 0.831 | 0.11; 0.02 | 61.08; 62.95 | 14.61; 7.66 | 2.4 |
| Comp 2 | 100 percent A | 20 | 125 | Mono | 0.984 | 0.12; 0.02 | 32.63; 45.06 | 11.08; 5.56 | 2.6 |
| Comp 2 | 100 percent A | 20 | 120 | Mono | 0.997 | 0.13; 0.05 | 24.95; 36.27 | 9.32; 4.10 | 2.3 |
| Comp 3 | 100 percent A | 28 | 130 | Mono | 0.885 | 0.29; 0.03 | 65.07; 72.81 | 20.37; 11.42 | 2.2 |
| Comp 4 | 100 percent B | 21 | 125 | Mono | 0.678 | 0.08; 0.03 | 76.89; 84.20 | 13.72; 8.29 | 2.7 |
| Comp 5 | 100 percent B | 28 | 125 | Mono | 1.082 | 0.15; 0.02 | 71.50; 74.32 | 17.75; 10.45 | 2.6 |
| Comp 6 | 80 percent A/20 percent C Compounded | 21 | 130 | Mono | 0.53 | 0.06; 0.03 | 63.14; 91.56 | 12.0; 8.8 | 2.9 |
| Comp 7 | 80 percent A/20 percent C Compounded | 28 | 130 | Mono | 0.56 | 0.16; 0.07 | 86.02; 109.51 | 17.79; 13.22 | 2.4 |
| Comp 8 | 80 percent A/20 percent C Dry Blended | 21 | 130 | Mono | 0.42 | 0.07; 0.03 | 57.98; 86.16 | 11.45; 8.15 | 3 |
| 9 | 100 percent D | 20 | 135 | Mono | 0.399 | 0.07; 0.02 | 71.3; 100.16 | 7.25; 5.90 | 3 |
| 10 | 100 percent D | 27 | 135 | Mono | 0.491 | 0.14; 0.06 | 98.79; 125.78 | 11.28; 9.54 | NA |
| 11 | 100 percent E | 20 | 135 | Mono | 0.411 | 0.08; 0.03 | 69.35; 97.99 | 7.30; 6.09 | 4 |
| 12 | 100 percent E | 27 | 135 | Mono | 0.653 | 0.22; 0.07 | 89.60; 123.71 | 11.33; 9.76 | NA |
| 13 | 100 percent F | 20 | 135 | Mono | 0.421 | 0.09; 0.03 | 75.04; 105.15 | 7.02; 6.15 | 3.7 |
| 14 | 100 percent F | 27 | 135 | Mono | 0.534 | 0.22; 0.07 | 93.45; 118.21 | 11.36; 9.21 | NA |
| 15 | 100 percent G | 20 | 135 | Mono | 0.435 | 0.08; 0.03 | 59.55; 96.78 | 8.25; 7.12 | NA |
| 16 | 100 percent G | 27 | 135 | Mono | 0.625 | 0.19; 0.06 | 95.89; 116.26 | 13.26; 11.13 | NA |
| Comp 17 | 55 percent A/45 percent C Dry Blended | 20 | 125 | Mono | 0.487 | 0.07; 0.02 | 88.1; 113.8 | 12.32; 7.71 | NA |
| Comp 18 | 55 percent A/45 percent C Dry Blended | 27 | 125 | Mono | 0.673 | 0.12; 0.03 | 103.0; 139.5 | 17.40; 11.60 | NA |

What is claimed is:

1. A nonwoven material comprised of fibers having a surface comprising a polyethylene blend, said fibers being selected from the group consisting of monocomponent fibers, bicomponent fibers or mixtures thereof, said nonwoven material having a fuzz/abrasion less than or equal to 0.0214(BW)+0.2714 mg/cm$^2$ when the material comprises monocomponent fibers and said nonwoven material having a fuzz/abrasion less than or equal to 0.0071(BW)+0.4071 mg/cm$^2$ when the material consists of bicomponent fibers, wherein BW is the basis weight of the nonwoven material, wherein the fibers are from 0.1 to 50 denier and wherein the polymer blend comprises:

a. from 40 weight percent to 80 weight percent (by weight of the polymer blend) of a first polymer which is a homogeneous ethylene/α-olefin interpolymer having:
   i. a melt index of from about 1 to about 1000 grams/10 minutes,
   ii. a density of from 0.915 to 0.950 grams/centimeter$^3$, and
   iii. a molecular weight distribution, Mw/Mn, defined by the equation Mw/Mn≤(I10/I2)−4.63, wherein Mw is the weight average molecular weight and Mn is the number average molecular weight; and b. from 60 to 20 percent by weight of a second polymer which is an ethylene homopolymer or an ethylene/α-olefin interpolymer having:
   i. a melt index of from about 1 to about 1000 grams/10 minutes, and
   ii. a density which is at least 0.01 grams/centimeter$^3$ greater than the density of the first polymer;

wherein the overall melt index of the polymer blend is greater than 18 grams/10 min.

2. The nonwoven material of claim 1 wherein the material comprises monocomponent fibers and has a fuzz/abrasion less than or equal to 0.0214(BW)+0.0714 mg/cm$^2$.

3. The nonwoven material of claim 1 wherein the material consists of bicomponent fibers and has a fuzz/abrasion less than or equal to 0.0143(BW)+0.1143 mg/cm$^2$.

4. The nonwoven material of claim 1 further characterized as having a basis weight of less than 60 GSM.

5. The nonwoven material of claim 1 further characterized as having a tensile strength of greater than 10 N/5 cm in MD.

6. The nonwoven of claim 1 further characterized as having a consolidation area of less than 25%.

7. The nonwoven of claim 1 having a basis weight from about 20 GSM to about 30 GSM.

8. The nonwoven of claim 1 wherein the nonwoven is a spunbond fabric.

9. The nonwoven material of claim 1 wherein fiber is a spunbonded fiber.

10. The nonwoven material of claim 1 wherein the first polymer has a melt index greater than 10 g/10 minutes.

11. The nonwoven material of claim 1 wherein the first polymer has a density in the range of 0.915 to .925 grams/centimeter$^3$.

12. The nonwoven material of claim 1 wherein the second polymer has a density which is at least 0.02 grams/centimeter$^3$ greater than the density of the first polymer.

13. The nonwoven material of claim 1 wherein the material comprises monocomponent fibers and has a flexural rigidity (mN'cm) in the machine direction of less than or equal to 0.0286(BW)−0.3714 and the nonwoven has a basis weight in the range of 20-27 GSM.

14. The nonwoven material of claim 1 wherein the material comprises bicomponent fibers and has a flexural rigidity (mN·cm) less than or equal to 0.0714(BW)−1.0786.

15. A fiber having a diameter in a range of from 0.1 to 50 denier, said fiber comprising a polymer blend, wherein the polymer blend comprises:

a. from 40 weight percent to 80 weight percent (by weight of the polymer blend) of a first polymer which is a homogeneous ethylene/α-olefin interpolymer having:
   i. a melt index of from about 1 to about 1000 grams/10 minutes,
   ii. a density of from 0.915 to 0.950 grams/centimeter$^3$, and
   iii. a molecular weight distribution, Mw/Mn, defined by the equation Mw/Mn≤(I10/I2)−4.63, wherein Mw is the weight average molecular weight and Mn is the number average molecular weight; and
b. from 60 to 20 percent by weight of a second polymer which is an ethylene homopolymer or an ethylene/α-olefin interpolymer having:
   i. a melt index of from about 1 to about 1000 grams/10 minutes, and
   ii. a density which is at least 0.01 grams/centimeter$^3$ greater than the density of the first polymer;

wherein the overall melt index for the polymer blend is greater than 18 g/10 min.

16. A fiber having a diameter in a range of from 0.1 to 50 denier, said fiber comprising a polymer blend, wherein the polymer blend comprises:

a. from 40 weight percent to 80 weight percent (by weight of the polymer blend) of a first polymer which is a homogeneous ethylene/α-olefin interpolymer having:
   i. a melt index of from about 1 to about 1000 grams/10 minutes,
   ii. a density of from 0.921 to 0.950 grams/centimeter$^3$, and
   iii. a molecular weight distribution, Mw/Mn, defined by the equation Mw/Mn≤(I10/I2)−4.63, wherein Mw is the weight average molecular weight and Mn is the number average molecular weight; and
b. from 60 to 20 percent by weight of a second polymer which is an ethylene homopolymer or an ethylene/α-olefin interpolymer having:
   i. a melt index of from about 1 to about 1000 grams/10 minutes, and
   ii. a density which is at least 0.01 grams/centimeter$^3$ greater than the density of the first polymer.

17. The fiber of claim 15 or 16 wherein the fiber is a spunbond fiber.

18. The fiber of claim 15 or 16 wherein the first polymer comprises 40-60% of the blend.

19. The fiber of claim 15 or 16 wherein the second polymer is a linear ethylene polymer or a substantially linear ethylene polymer.

20. The fiber of claim 15 or 16 wherein the first polymer has a melt index greater than 10 g/10 minutes.

21. The fiber of claim 15 wherein the first polymer has a density in the range of 0.915 to 0.925 grams/centimeter$^3$.

22. The fiber of claim 15 or 16 wherein the second polymer has a density which is at least 0.02 grams/centimeter$^3$ greater than the density of the first polymer.

23. The fiber of claim 16 wherein the overall polymer blend has a melt index greater than 18 g/10 minutes.

24. A fiber of claim 15 or 16 wherein the fiber is selected from the group consisting of staple fibers and binder fibers.

25. The fiber of claim 24 wherein the fiber is a binder fiber and the binder fiber is in the form a sheath-core bicomponent fiber and the sheath of the fiber comprises the polymer blend.

26. The fiber of claim 25 wherein the sheath further comprises a polyolefin grafted with an unsaturated organic compound containing at least one site of ethylenic unsaturation and at least one carbonyl group.

27. The fiber of claim 26 wherein the unsaturated organic compound is maleic anhydride.

28. The fiber of claim 24 wherein the fiber is a binder fiber and the binder fiber is in an airlaid web, and the fiber comprises 5-35% by weight of the airlaid web.

29. The fiber of claim 24 wherein the fiber is a staple fiber and the stable fiber is in a carded web.

* * * * *